US008512048B2

(12) United States Patent
Yasuoka et al.

(10) Patent No.: US 8,512,048 B2
(45) Date of Patent: Aug. 20, 2013

(54) EXPANSION DEVICE CONNECTABLE TO ELECTRONIC DEVICE

(75) Inventors: Syuji Yasuoka, Osaka (JP); Hideki Harada, Osaka (JP); Norihiro Asano, Osaka (JP)

(73) Assignee: Panasonic Corporation, Osaka (JP)

( * ) Notice: Subject to any disclaimer, the term of this patent is extended or adjusted under 35 U.S.C. 154(b) by 129 days.

(21) Appl. No.: 13/106,190

(22) Filed: May 12, 2011

(65) Prior Publication Data

US 2011/0281444 A1 Nov. 17, 2011

(30) Foreign Application Priority Data

May 14, 2010 (JP) ..... 2010-112380

(51) Int. Cl.
*H01R 11/30* (2006.01)

(52) U.S. Cl.
USPC ..... 439/39

(58) Field of Classification Search
USPC ..... 439/37–40
See application file for complete search history.

(56) References Cited

U.S. PATENT DOCUMENTS 4,210,790 A * 7/1980 Kurosawa et al. ..... 218/127
4,532,391 A * 7/1985 Bernt ..... 218/128
4,935,588 A * 6/1990 Hess et al. ..... 218/123
5,495,085 A * 2/1996 Yorita et al. ..... 218/123
5,572,441 A 11/1996 Boie
5,597,993 A * 1/1997 Yorita et al. ..... 218/129
6,639,169 B2 * 10/2003 Matsui et al. ..... 218/128
6,740,838 B2 * 5/2004 Matsui et al. ..... 218/118
6,891,121 B2 * 5/2005 Ren ..... 218/130

FOREIGN PATENT DOCUMENTS

JP 5-217620 8/1993
JP 7-295704 11/1995
JP 2009-217774 9/2009

* cited by examiner

*Primary Examiner* — Jean F Duverne
(74) *Attorney, Agent, or Firm* — Hamre, Schumann, Mueller & Larson, P.C.

(57) ABSTRACT

A portable computer 1 has a first metallic portion 6 and a second metallic portion 7, and an expansion device 10 has a first magnet 16 and a second magnet 17, whereby the expansion device 10 can be attached to a predetermined position of the portable computer 1 using attractive forces generated by the magnets. Therefore, when the portable computer 1 to which the expansion device 10 is attached is dropped mistakenly on a floor, etc., and the impact is applied on the expansion device 10, the expansion device 10 is separated from the portable computer 1 easily. Thus, even if the expansion device 10 is damaged, the impact to be transmitted to the portable computer 1 can be reduced by separating the expansion device 10 from the portable computer 1, which reduces damage to the portable computer 1.

5 Claims, 11 Drawing Sheets

EXPANSION DEVICE CONNECTABLE TO ELECTRONIC DEVICE

BACKGROUND

1. Field

The present application relates to an expansion device connectable to an electronic device.

2. Description of Related Art

In order to improve the practicality of electronic devices, connection means attachable/detachable with respect to the electronic device even when peripheral devices are connected to the connection means have been developed. Such connection means improve the expandability of peripheral devices, and the range in which they can be used is broadening.

JP 05(1993)-217620 A discloses that, in a configuration in which an electronic device such as a notebook computer and a peripheral device are connected via a cable, a connector provided at an end of the cable is fixed to a connecter on a portable device side with screws.

However, in the configuration disclosed by JP 05-217620 A, since the connector is connected to the electronic device using the screws, it takes time to attach/detach the connector to/from the electronic device.

Further, if an electronic device to which a connector is connected is dropped mistakenly on a floor or the like during carriage and a large load or impact is applied on the connector, the connector and the electronic device are damaged in some cases. If both the connector and the terminal are damaged, both the electronic device and the connector need to be repaired, which results in an increase in a repair cost.

SUMMARY

An expansion device disclosed by the present application is an expansion device that is attachable/detachable with respect to an attachment face of an electronic device provided with a connection terminal, including: a terminal electrically connectable to the connection terminal; a magnet capable of adsorbing a predetermined position of the electronic device; and a support portion capable of supporting a side face adjacent to the attachment face of the electronic device, wherein the terminal and the magnet are arranged in an attachable face of the expansion device, and when the attachable face is positioned to be opposed to the attachment face and the expansion device is brought into contact with the attachment face of the electronic device, the magnet adsorbs the predetermined position of the electronic device and the terminal and the connection terminal are connected electrically to each other, whereby the support portion supports the side face of the electronic device.

DETAILED DESCRIPTION OF THE EMBODIMENT

Embodiment

[1. Configuration of Electronic Device]

Hereinafter, a portable computer will be described as an example of an electronic device according to the present embodiment.

Figure 1:
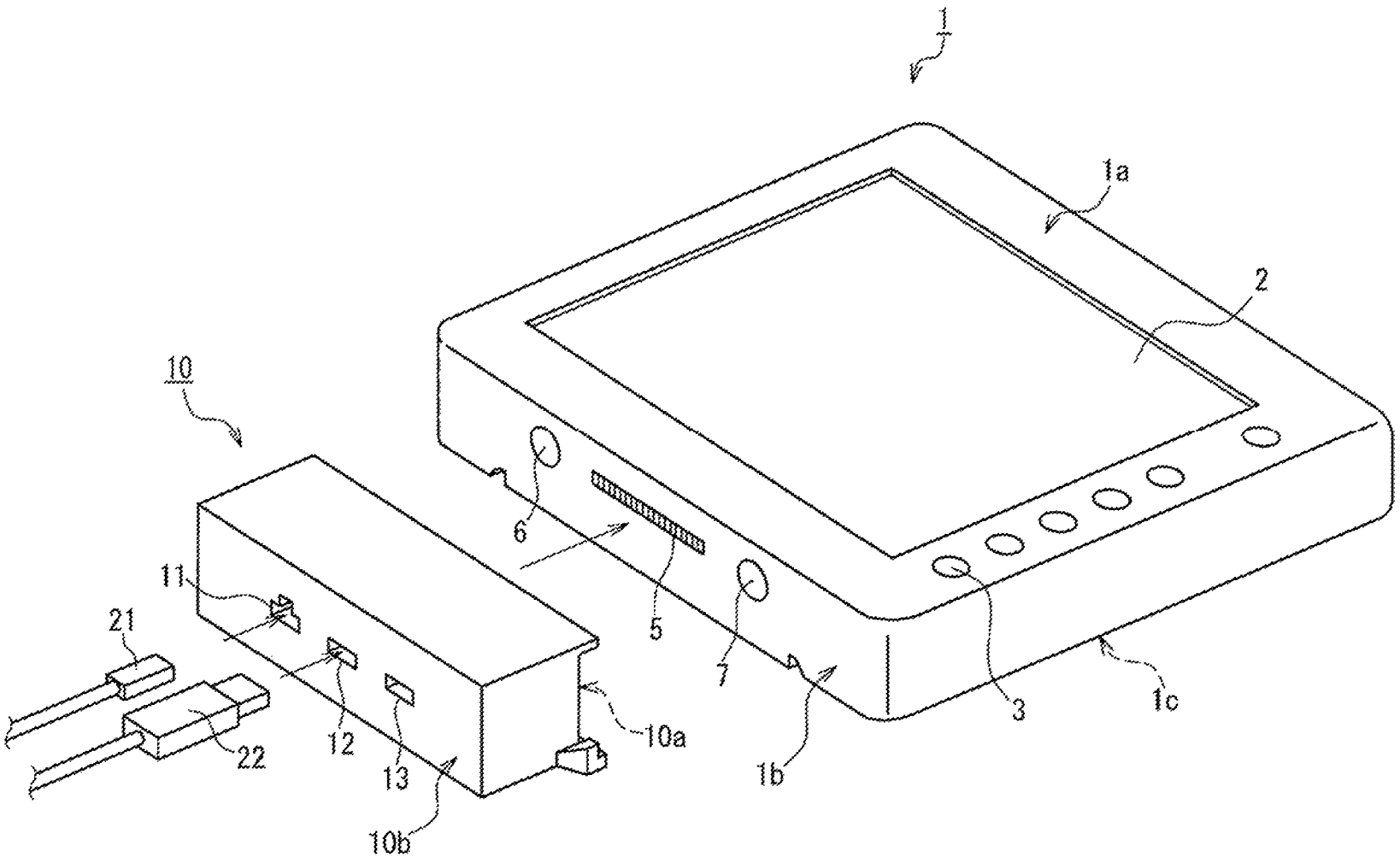
FIG. 1 is a perspective view of an expansion device and a portable computer according to the present embodiment.
Figure 2:
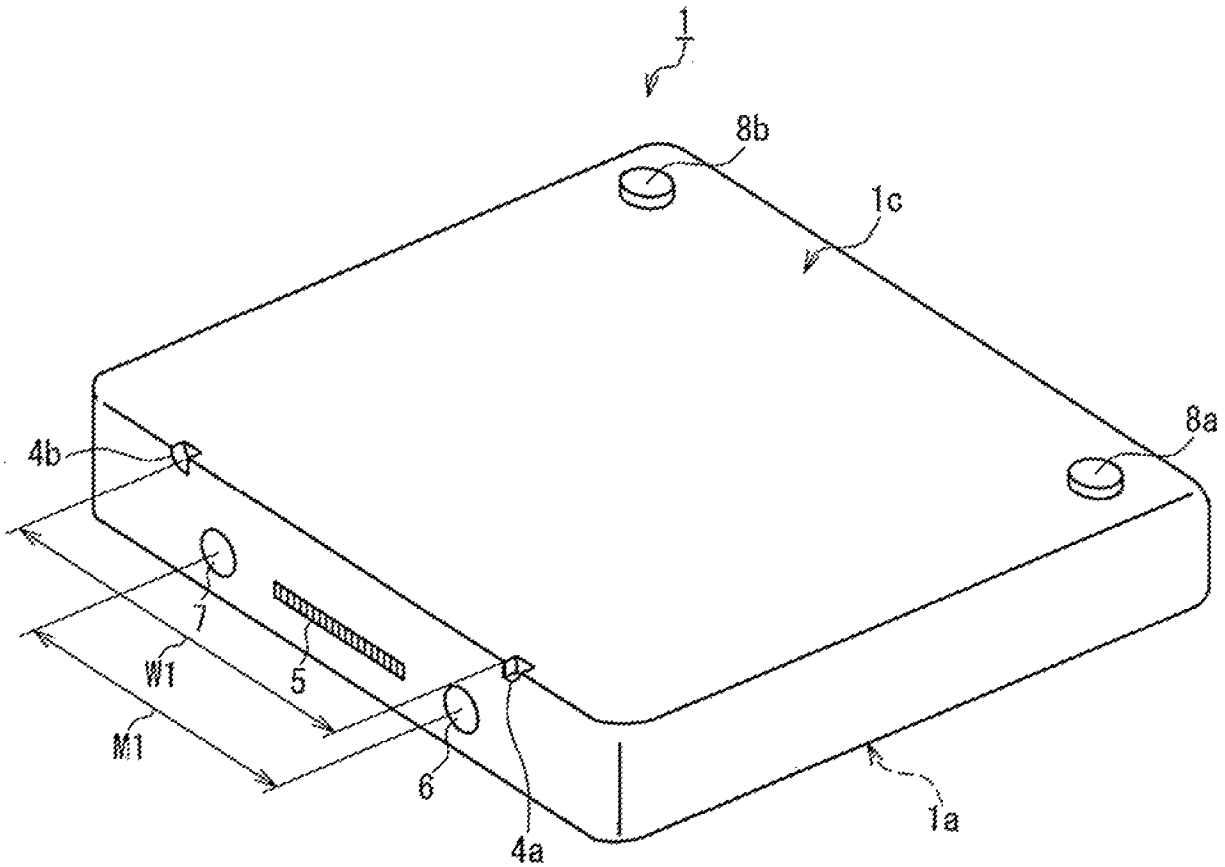
FIG. 2 is a perspective view of a lower face side of the portable computer according to the present embodiment.

FIG. 1 is a perspective view showing appearances of a portable computer, an expansion device and cables according to the present embodiment. FIG. 2 is a perspective view of a lower face side of the portable computer according to the present embodiment.

In the present invention, although the portable computer is given as an example of the electronic device, the electronic device is not limited hereto as long as it at least is a device to which an expansion device is connectable. The electronic device may be a notebook computer, a mobile phone terminal, a portable music player or the like, other than a portable computer. The main feature of the expansion device is to expand a function or specification of the electronic device.

A portable computer 1 includes various electric components (not shown) such as a central processing unit and a memory in a single housing. An upper face 1*a* of the portable computer 1 is provided with a display panel 2 and operation buttons 3. The display panel 2 can display images generated by the various electric components housed in the portable computer 1. The operation buttons 3 can, for example, receive an ON/OFF operation of the portable computer 1 by a user and receive information input by the user.

A side face 1*b* of the portable computer 1 is provided with a first terminal portion 5, a first metallic portion 6 and a second metallic portion 7. The first terminal portion 5 has a plurality of electrical contacts. When an expansion device 10 is attached to the portable computer 1, a second terminal portion 15 (described later) provided in the expansion device 10 is connected electrically to the first terminal portion 5. This electrical connection between the first terminal portion 5 and the second terminal portion 15 (described later) allows electric signals generated by the various electric components housed in the portable computer 1 to be sent to the expansion device 10 and electric signals sent from the expansion device 10 to be sent to the various electric components in the portable computer 1. Each of the first metallic portion 6 and the second metallic portion 7 is a part of a metallic ground plate (not shown) arranged in the portable computer 1 and is exposed from a circular opening formed in the side face 1*b*. Further, each of the first metallic portion 6 and the second metallic portion 7 is connected electrically to a part in the portable computer 1 that is electrically grounded (i.e., ground potential). The first metallic portion 6 and the second metallic portion 7 are arranged near both ends of the first terminal portion 5 in a longitudinal direction.

The expansion device 10 is attachable/detachable with respect to a predetermined position in the side face 1*b* of the portable computer 1. A side face 10*b* of the expansion device 10 is provided with a LAN port 11, a first USB port 12 and a second USB port 13. ALAN cable 21 is attachable/detachable with respect to the LAN port 11. A USB cable 22 is attachable/detachable with respect to the first USB port 12 and the second USB port 13. Note here that, although the expansion device 10 according to the present embodiment includes the LAN port 11, the first USB port 12 and the second USB port 13, the ports to be provided are not limited hereto. The expansion device 10 may include a display port to which an external display device is connectable and a power source port to which an external power source is connectable.

Note here that the "predetermined position" is a position near the first terminal portion 5, the first metallic portion 6 and the second metallic portion 7 in the side face 1*b* of the portable computer 1. The "predetermined position" is an attachment position of the expansion device 10 where the first terminal portion 5 provided in the portable computer 1 and the second terminal portion 15 (described later) provided in the expansion device 10 become capable of being electrically connected to each other.

As shown in FIG. 2, a first concave portion 4*a* and a second concave portion 4*b* are formed on an edge of the portable computer 1 where the side face 1*b* and the lower face 1*c* (back face of the upper face 1*a*) intersect with each other. A dimension W1 is a space between the first concave portion 4*a* and the second concave portion 4*b*. Feet 8*a* and 8*b* are disposed on the lower face 1*c* of the portable computer 1.

[2. Configuration of Expansion Device]

Figure 3:
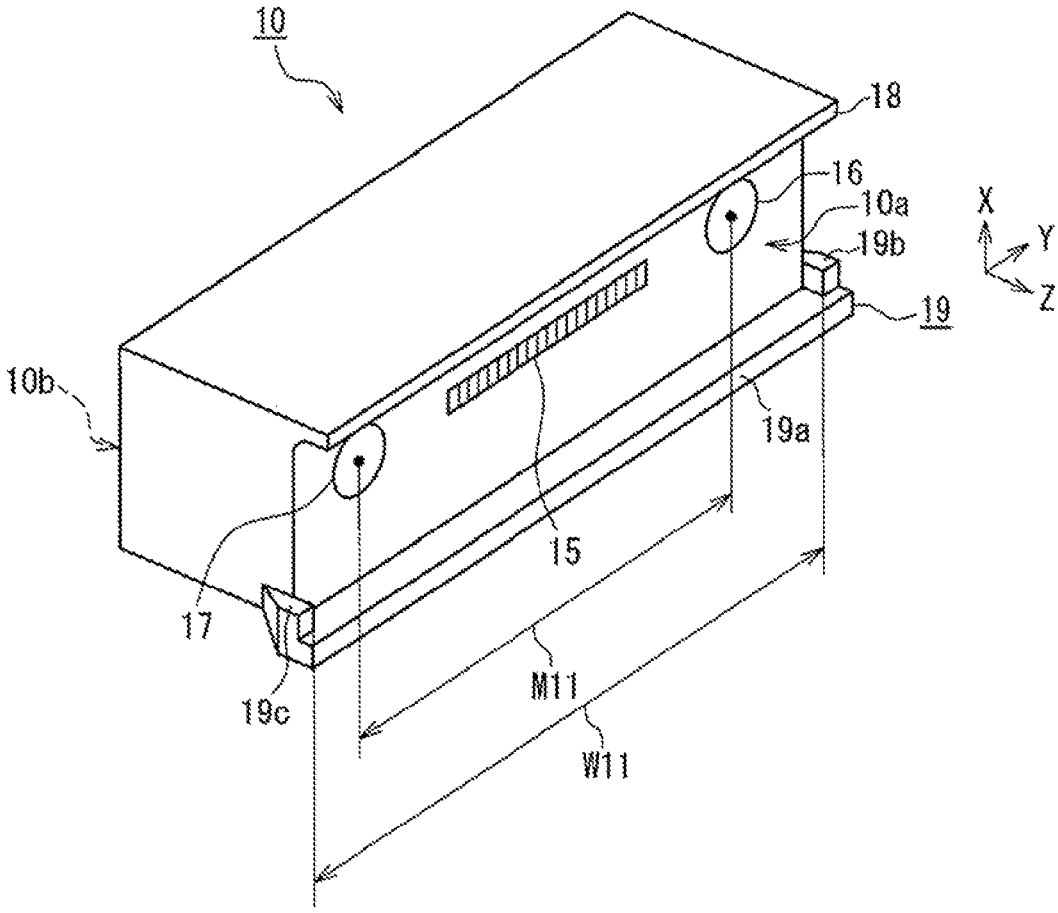
FIG. 3 is a perspective view of the expansion device according to the present embodiment.

FIG. 3 is a perspective view of the expansion device 10 on a side face 10*a* side. Note here that the side face 10*a* is a back face of the side face 10*b*. As shown in FIG. 3, the side face 10*a* of the expansion device 10 is provided with the second terminal portion 15, a first magnet 16 and a second magnet 17. The expansion device 10 includes a first support portion 18 and a second support portion 19 in such a manner that they protrude from the side face 10*a* toward the normal direction (Z-axis direction).

The second terminal portion 15 has a plurality of electrical contacts. The number and the pin position of the electrical contacts provided in the second terminal portion 15 are the same as those provided in the first terminal portion 5 of the portable computer 1. The second terminal portion 15 is connected electrically to an electric circuit board housed in the expansion device 10. By attaching the expansion device 10 to the predetermined position of the portable computer 1, the second terminal portion 15 is connected electrically to the first terminal portion 5.

When the expansion device 10 is attached to the predetermined position of the portable computer 1, the first magnet 16 can adsorb the first metallic portion 6 and the second magnet 17 can adsorb the second metallic portion 7. In other words, a space M11 between a center of first magnet 16 and a center of the second magnet 17 is the same as a space M1 (see FIG. 2) between a center of the first metallic portion 6 and a center of the, second metallic portion 7. In the present embodiment, "the space M11 is the same as the space M1" is not limited to the case where the space M11 perfectly coincides with the space M1. The space M1 and the space M11 need not coincide with each other exactly as long as at least the first magnet 16 can adsorb the first metallic portion 6 and the second magnet 17 can adsorb the second metallic portion 7.

The first magnet 16 and the second magnet 17 are arranged near both ends of the second terminal portion 15 in the longitudinal direction (Y-axis direction). With this arrangement, when the expansion device 10 is attached to the portable computer 1, it is possible to suppress variations in the relative position of the second terminal portion 15 with respect to the first terminal portion 5.

Note here that magnetic forces of the first magnet 16 and the second magnet 17 preferably are set to the extent that, from the state where the expansion device 10 is attached to the predetermined position in the side face 1*b* of the portable computer 1, at least the expansion device 10 is not separated from the portable computer 1 due to its own weight. Further, the first magnet 16 and the second magnet 17 are connected electrically to a ground terminal or the like in the expansion device 10, whereby they electrically are ground potentials.

The first support portion 18 is formed in the vicinity of one long side of the side face 10*a* of the expansion device 10 in such a manner as to protrude toward the normal direction (Z-axis direction) of the side face 10*a*. The first support portion 18 is arranged so that it can come into contact with the upper face 1*a* of the portable computer 1 when the expansion device 10 is attached to the predetermined position of the portable computer 1.

The second support portion 19 is formed in the vicinity of the other long side of the side face 10*a* of the expansion device 10 in such a manner as to protrude toward the normal direction (Z-axis direction) and a plane direction (X-axis direction) of the side face 10*a*. The second support portion 19 is arranged so that it can come into contact with the lower face 1*c* of the portable computer 1 when the expansion device 10 is attached to the predetermined position of the portable computer 1. The second support portion 19 includes a first protrusion portion 19*a*, a second protrusion portion 19*b* and a third protrusion portion 19*c*. The first protrusion portion 19*a* protrudes toward the plane direction (X-axis direction) of the side face 10*a*. The second protrusion portion 19*b* and the third protrusion portion 19*c* protrude toward the normal direction (Z-axis direction) of the side face 10*a*. The second protrusion portion 19*b* and the third protrusion portion 19*c* are formed on both ends of the side face 10*a* in the longitudinal direction (Y-axis direction). The second protrusion portion 19*b* is engageable with the first concave portion 4*a* (see FIG. 2) formed in the portable computer 1. The third protrusion portion 19*c* is engageable with the second concave portion 4*b* (see FIG. 2) formed in the portable computer 1.

[3. Attaching/Detaching Operation of Expansion Device 10]

Figure 4A:
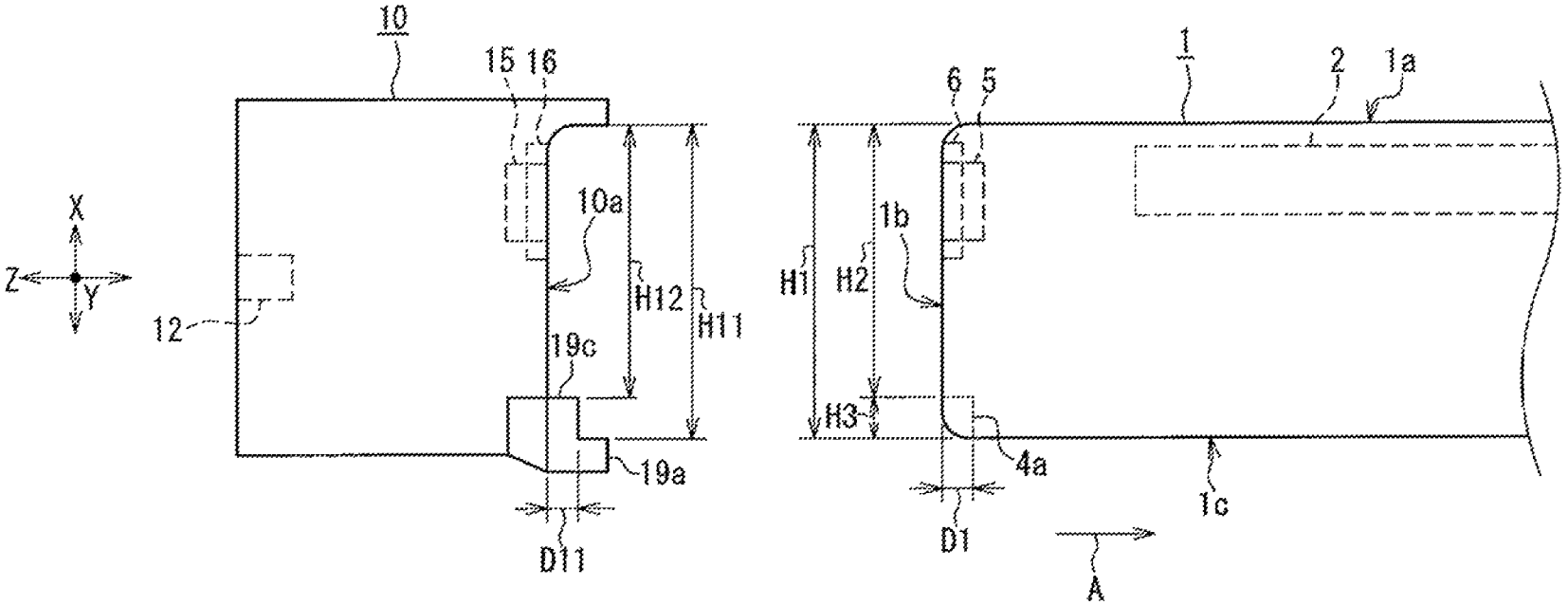
FIG. 4A is a side view showing a state before the expansion device is connected to the portable computer.
Figure 4B:
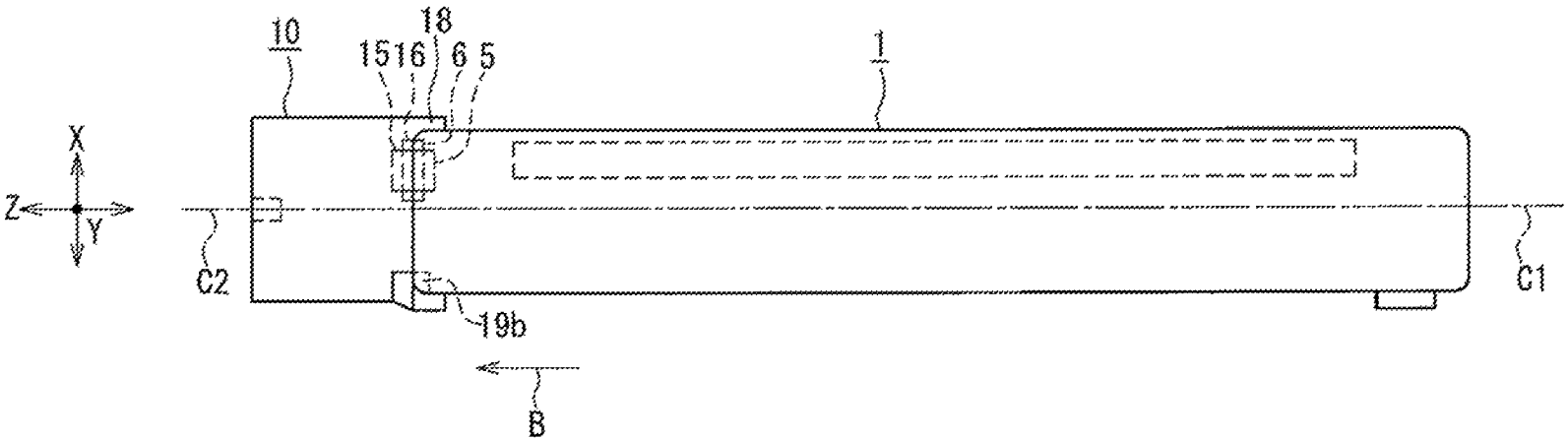
FIG. 4B is a side view showing a state where the expansion device is connected to the portable computer.
Figure 4C:
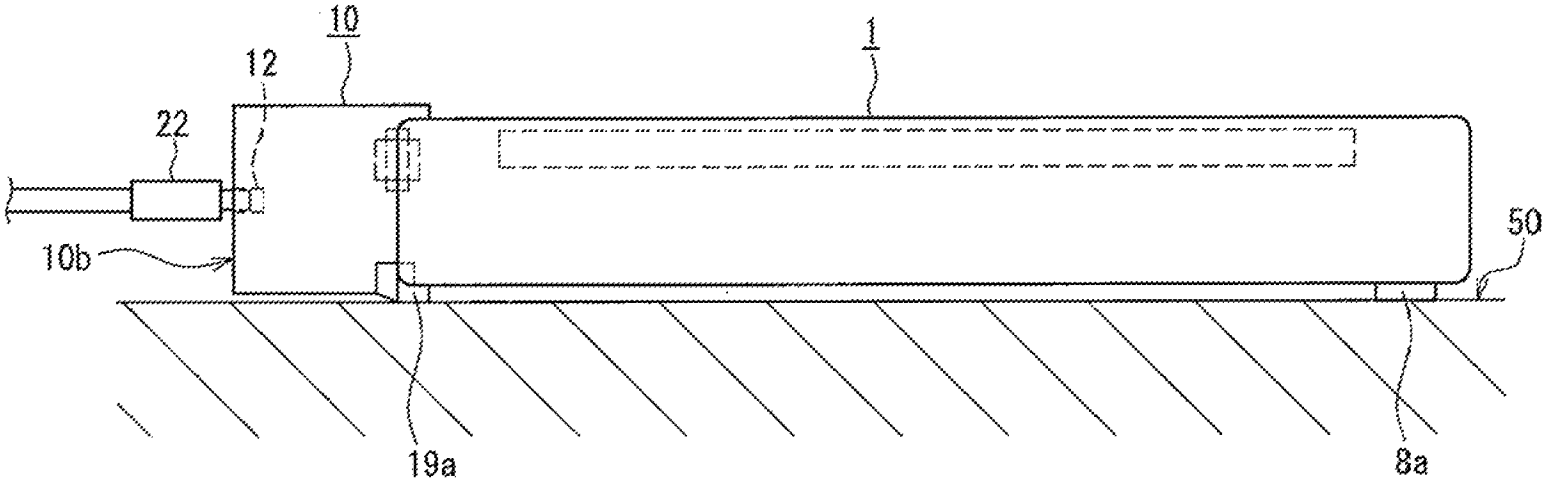
FIG. 4C is a side view showing a state where the portable computer to which the expansion device is connected is placed on a desk.
Figure 5:
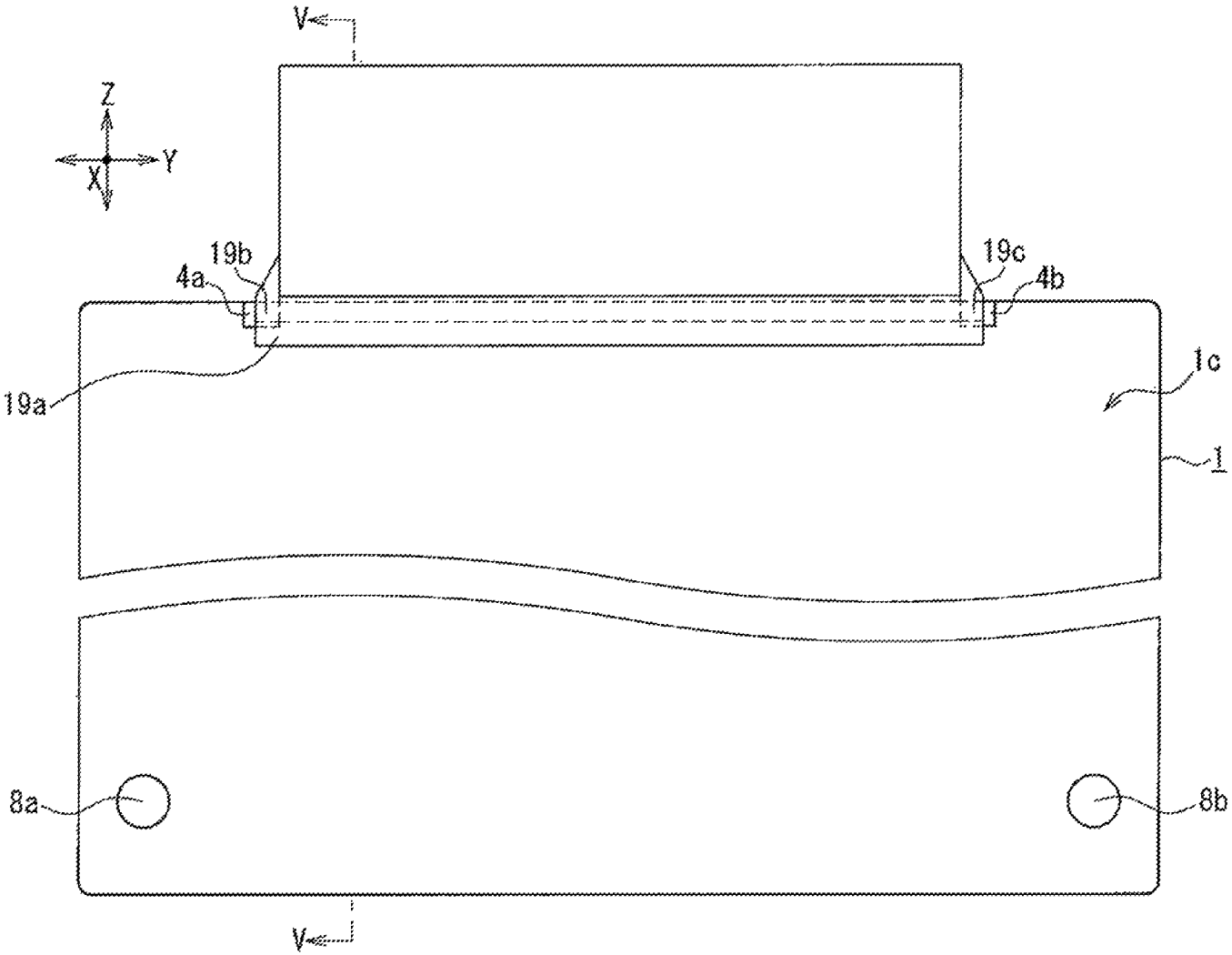
FIG. 5 is a plan view of a lower face side of the portable computer and the expansion device.
Figure 6:
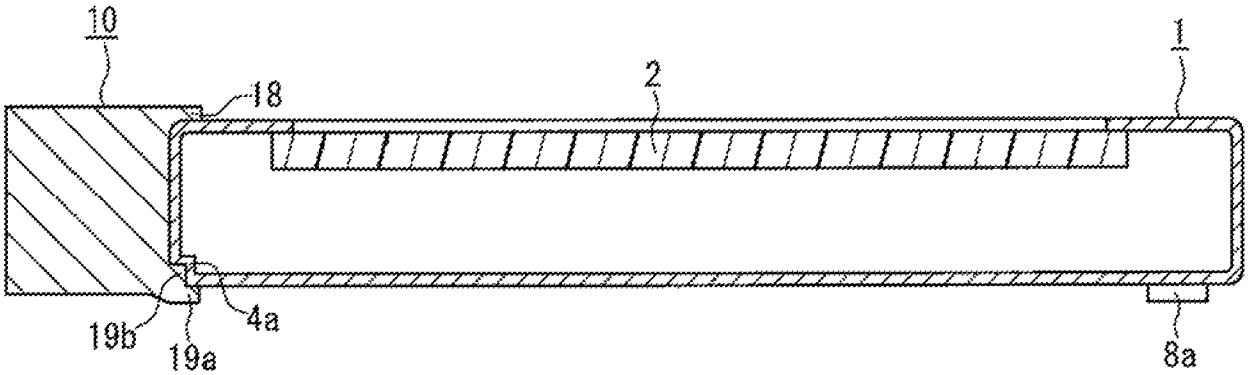
FIG. 6 is a cross-sectional view taken along a line V-V in FIG. 5.

FIG. 4A is a side view showing a state before the expansion device 10 is attached to the portable computer 1. FIG. 4B is a side view showing a state where the expansion device 10 is attached to the portable computer 1. FIG. 4C is a side view showing a state where the USB cable 22 is connected to the expansion device 10. FIG. 4A is a side view enlarging the vicinity of the side face 1*b* and the side face 10*a* for clearly illustrating a dimensional relationship between the portable computer 1 and the expansion device 10. FIG. 5 is a plan view of the lower face 1*c* side of the portable computer 1 to which the expansion device 10 is attached. FIG. 6 is a cross-sectional view taken along a line V-V in FIG. 5.

At the time of attaching the expansion device 10 to the portable computer 1, first, as shown in FIG. 4A, the side face 10*a* of the expansion device 10 is positioned to be opposed to the side face 1*b* of the portable computer 1, and placed so that the first support portion 18 can support the upper face 1*a* of the portable computer 1 and the second support portion 19 can support the lower face 1*c* of the portable computer 1.

Next, the expansion device 10 is moved in a direction indicated by an arrow A, so that the side face 10*a* contacts the side face 1*b* as shown in FIG. 4B. At this time, the first magnet 16 and the second magnet 17 are caused to adsorb the first metallic portion 6 and the second metallic portion 7, respectively. Thus, the expansion device 10 can be positioned in the predetermined position in the side face 1*b* of the portable computer 1. In the state shown in FIG. 4B, the second terminal portion 15 of the expansion device 10 contacts the first terminal portion 5 of the portable computer 1, whereby the first terminal portion 5 and the second terminal portion 15 are connected electrically.

Further, in the state shown in FIG. 4B, since the first support portion 18 is arranged so that it can come into contact with the upper face 1*a* of the portable computer 1 and the second support portion 19 is arranged so that it can come into contact with the lower face 1*c* of the portable computer 1, the position of the expansion device 10 with respect to the portable computer 1 is regulated in the X-axis direction. Specifically, since a thickness dimension H1 of the portable computer 1 shown in FIG. 4A and a space dimension H11 between the first support portion 18 and the second support portion 19 in the expansion device 10 establish the following relational expression (1), a part of the portable computer 1 is inserted in the space between the first support portion 18 and the second support portion 19.

$$H1 \leqq H11 \qquad \text{relational expression (1)}$$

Therefore, the position of the expansion device 10 with respect to the portable computer 1 is regulated in the X-axis direction.

Further, by attaching the expansion device 10 to the predetermined position in the side face 1*b* of the portable computer 1 as shown in FIG. 4B, the second protrusion portion 19*b* is engaged with the first concave portion 4*a* and the third protrusion portion 19*c* is engaged with the second concave portion 4*b* as shown in FIGS. 5 and 6. Specifically, a thickness dimension H2 of the portable computer 1 shown in FIG. 4A and a space dimension 1112 establish the following relational expression (2).

$$H2 \leqq H12 \qquad \text{relational expression (2)}$$

Note here that the thickness dimension H2 is a dimension obtained by subtracting a height dimension H3 of the first concave portion 4*a* from the thickness dimension H1 of the portable computer 1 shown in FIG. 4A A height dimension of the second concave portion 4*b* is equal to the height dimension H3. The space dimension 1112 is a dimension between the first support portion 18 and the third protrusion portion 19*c* in the expansion device 10. A space dimension between the first support portion 18 and the second protrusion portion 19*b* is equal to the space dimension H12.

Further, the space dimension W1 (see FIG. 2) and a space dimension W11 (see FIG. 3) establish the following relational expression (3). The space dimension W1 is a dimension between the first concave portion 4*a* and the second concave portion 4*b*. The space dimension W11 is a dimension between the second protrusion portion 19*b* and the third protrusion portion 19*c*.

$$W1 \leqq W11 \qquad \text{relational expression (3)}$$

Therefore, the second protrusion portion 19*b* is engaged with the first concave portion 4*a*, and the third protrusion portion 19*c* is engaged with the second concave portion 4*b*. By these engagements, it is possible to determine the position of the expansion device 10 with respect to the portable computer 1 in the Y-axis direction.

Further, a depth dimension D1 of the first concave portion 4*a* and a depth dimension D11 of the third protrusion portion 19*c* establish the following relational expression (4). A depth dimension of the second concave portion 4*b* is equal to the depth dimension D1. A depth dimension of the second protrusion portion 19*b* is equal to the depth dimension D11.

$$D11 \leqq D1 \qquad \text{relational expression (4)}$$

Thus, no significant gap is present between the side face 10*a* of the expansion device 10 and the side face 1*b* of the portable computer 1 while the expansion device 10 is attached to the predetermined position of the portable computer 1, whereby the electrical connection between the first terminal portion 5 and the second terminal portion 15 is achieved reliably. Further, since the first magnet 16 adsorbs the first metallic portion 6 reliably and the second magnet 17 adsorbs the second metallic portion 7 reliably, it is possible to determine the position of the expansion device 10 with respect to the portable computer 1 reliably.

Although it is ideal that all of the above-described relational expressions 1 to 4 establish an equality (=) relation, such a case reduces manufacturing tolerances. Considering manufacturing errors, the above-described relational expressions, in many cases, practically establish an inequality (<) relation.

As shown in FIG. 4C, when the portable computer 1 to which the expansion device 10 is attached is placed on a desk or the like, the feet 8*a*, 8*b* and the first protrusion portion 19*a* contact a desk surface 50. As shown in FIG. 4C, by providing the first protrusion portion 19*a* in the expansion device 10, the position of each port (e.g., the first USB port 12) provided in the side face 10*b* of the expansion device 10 can be spaced from the desk surface 50, whereby cables can be attached/detached with respect to each port easily.

Next, at the time of detaching the expansion device 10 from the portable computer 1, the expansion device 10 is moved from the state shown in FIG. 4B (or FIG. 4C) in a direction indicated by an arrow B. At this time, the expansion device 10 is moved to the position where the first magnet 16 and the second magnet 17 do not adsorb the first metallic portion 6 and the second metallic portion 7, respectively. Thus, as shown in FIG. 4A, the expansion device 10 can be separated from the portable computer 1.

Figure 7A:
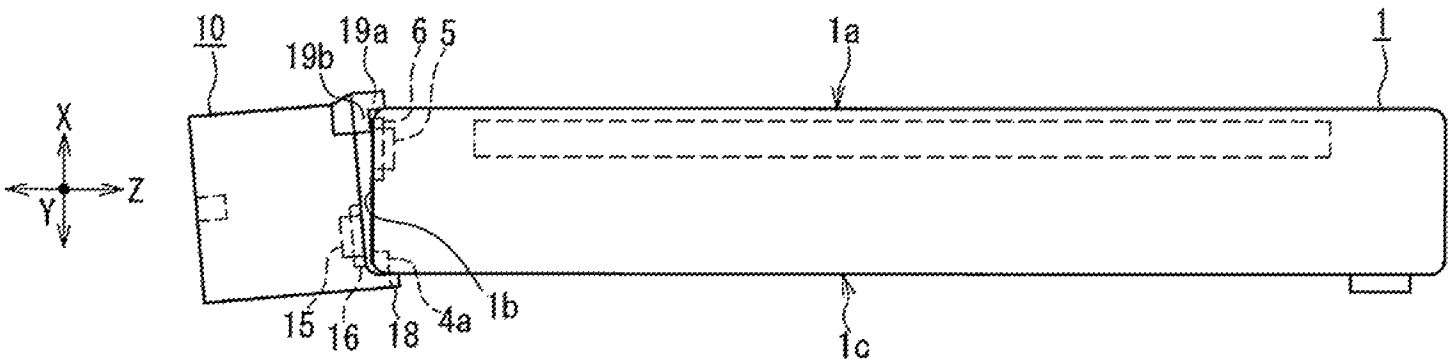
FIG. 7A is a side view showing a state where it is attempted to attach the expansion device in an upside-down posture.
Figure 7B:
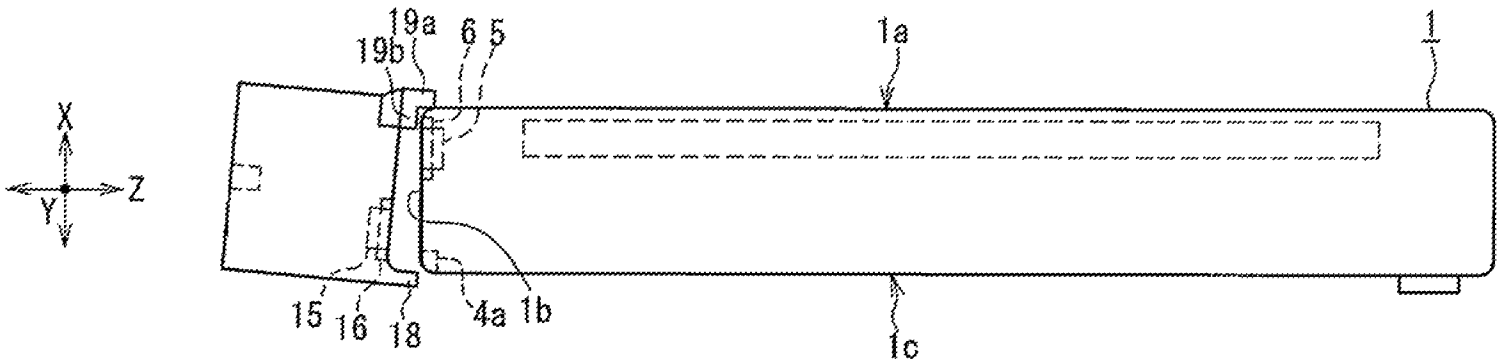
FIG. 7B is a side view showing a state where it is attempted to attach the expansion device in the upside-down posture.

FIGS. 7A and 7B are side views of the portable computer 1 and the expansion device 10, showing a state where it is attempted to attach the expansion device 10 to the portable computer 1 in an upside-down posture.

The "upside-down posture" refers to a posture in which the first support portion 18 is positioned near the lower face 1*c* of the portable computer 1 and the second support portion 19 is positioned near the upper face 1*a* of the portable computer 1. In the present embodiment, when it is attempted to attach the expansion device 10 to the predetermined position of the portable computer 1 in the upside-down posture, the second protrusion portion 19*b* and the third protrusion portion 19*c* (FIG. 7A only shows the second protrusion portion 19*b*) run upon the side face 1*b* as shown in FIG. 7A, or the first support portion 18 contacts the side face 1*b* as shown in FIG. 7B, thereby causing a gap between the side face 1*b* and the side face 10*a*. This gap has a dimension that does not allow the first magnet 16 and the second magnet 17 to adsorb the first metallic portion 6 and the second metallic portion 7, respectively, thereby preventing the electrical connection between the first terminal portion 5 and the second terminal portion 15. Thus, in the present embodiment, even when it is attempted to attach the expansion device 10 to the portable computer 1 in the upside-down posture, it is impossible to attach the expansion device 10 to the predetermined position of the portable computer 1.

If the expansion device 10 in the upside-down posture were to be attached to the portable computer 1 and the first terminal portion 5 and the second terminal portion 15 were to be connected electrically, false electric signals would be transmitted between the portable computer 1 and the expansion device 10. That is, the pin position of the first terminal portion 5 and the pin position of the second terminal portion 15 are predetermined such that the electrical contacts in the first terminal portion 5 and the electrical contacts in the second terminal portion 15 are connected electrically in the correct combination when the expansion device 10 is attached to the portable computer 1 in a normal posture. Therefore, if the expansion device 10 in the upside-down posture can be attached to the portable computer 1 and the first terminal portion 5 and the second terminal portion 15 are connected electrically, the electrical contacts in the first terminal portion 5 and the electrical contacts in the second terminal portion 15 can be connected electrically in the wrong combination. Such a configuration may cause malfunctions in the portable computer 1, the expansion device 10 and peripheral devices connected to the expansion device 10.

To cope with this, in the present embodiment, as shown in FIG. 4A, the space dimension H12 between the first support portion 18 and the third protrusion portion 19*c* (second protrusion portion 19*b*) and the thickness dimension H1 of the portable computer 1 establish the following relational expression (5).

$$H12 \leqq H1 \qquad \text{relational expression (5)}$$

By satisfying the relational expression (5), a portion near the side face 1*b* of the portable computer 1 cannot be fitted between the first support portion 18 and the second protrusion portion 19*b* and between the first support portion 18 and the third protrusion portion 19*c*.

Thus, when it is attempted to attach the expansion device 10 to the portable computer 1 in the upside-down posture, the second protrusion portion 19*b* and the third protrusion portion 19*c* run upon the side face 1*b* as shown in FIG. 7A, or the first support portion 18 contacts the side face 1*b* as shown in FIG. 7B, thereby causing a gap between the side face 1*b* and the side face 10*a*. The dimension of this gap is such that the first magnet 16 and the second magnet 17 cannot adsorb the first metallic portion 6 and the second metallic portion 7, respectively, or such that an extremely weak attractive force that is only sufficient for causing the expansion device 10 to follow the portable computer 1 against the own weight is generated between the first magnet 16, second magnet 17 and the first metallic portion 6, second metallic portion 7, respectively. Such a gap prevents the expansion device 10 from being attached to the predetermined position of the portable computer 1. Further, since the gap not allowing electric signals to be transmitted between the first terminal portion 5 and the second terminal portion 15 is present between the side face 1*b* and the side face 10*a*, it is possible to prevent malfunctions in the portable computer 1 and the expansion device 10.

Further, as shown in FIG. 4B, by arranging the first terminal portion 5 at a position displaced in a thickness direction (X-axis direction) with respect to a centerline C1 of the portable computer 1 and arranging the second terminal portion 15 at a position displaced in the thickness direction (X-axis direction) with respect to a centerline C2 of the expansion device 10, the first terminal portion 5 does not face the second terminal portion 15 when the expansion device 10 is in the upside-down posture. Therefore, it is possible to prevent the first terminal portion 5 and the second terminal portion 15 from being electrically connected when the electrical contacts are in the wrong combination.

Note here that the first terminal portion 5 and the second terminal portion 15 may be arranged at a position where they face each other (for example, on the centerline C2), as long as they will not be connected electrically with each other when the expansion device 10 is in the upside-down posture. In the present embodiment, when the expansion device 10 is in the upside-down posture, the second protrusion portion 19*b* and the third protrusion portion 19*c* contact the side face 1*b* of the portable computer 1, thereby causing a gap between the side face 1*b* and the side face 10*a* to separate the first terminal portion 5 and the second terminal portion 15.

Further, as shown in FIG. 4B, by arranging the first metallic portion 6 (the same can be said about the second metallic portion 7) at a position displaced in the thickness direction (X-axis direction) with respect to the. centerline C1 of the portable. computer 1 and arranging the first magnet 16 (the same can be said about the second magnet 17) at a position displaced in the thickness direction (X-axis direction) with respect to the centerline C2 of the expansion device 10, the first metallic portion 6 does not face the first magnet 16 when the expansion device 10 is in the upside-down posture (the second metallic portion 7 also does not face the second magnet 17). Because of this, attractive forces generated by the first magnet 16 and the second magnet 17 are less likely to act on the first metallic portion 6 and the second metallic portion 7, whereby the expansion device 10 cannot be attached to the portable computer 1. Therefore, it is possible to prevent the first terminal portion 5 and the second terminal portion 15 from being electrically connected when the electrical contacts are in the wrong combination.

Note here that the first metallic portion 6 and the first magnet 16 may be arranged at the position where they face each other. Further, the second metallic portion 7 and the second magnet 17 may be arranged at the position where they face each other. Specifically, when the expansion device 10 is in the upside-down posture, the second protrusion portion 19*b* and the third protrusion portion 19*c* contact the side face 1*b* of the portable computer 1, thereby causing a gap between the side face 1*b* and the side face 10*a* to separate the first terminal portion 5 and the second terminal portion 15. Therefore, there is no problem to arrange the first metallic portion 6 and the second metallic portion 7 to face the first magnet 16 and the second magnet 17, respectively.

Further, it is preferable that the portable computer 1 includes a magnetic-field-detecting element that detects magnetic fields generated by the first magnet 16 and the second magnet 17 in the expansion device 10. Specifically, it is preferable that the portable computer 1 includes the magnetic-field-detecting element, a switch that switches whether an information signal is transmitted to the first terminal portion 5 or not, and a control portion that controls ON/OFF of the switch in accordance with the magnetic field intensity detected by the magnetic-field-detecting element. With this configuration, it is possible selectively to control transmission/reception of signals between the expansion device 10 and the portable computer 1 in accordance with the position of the first magnet 16 and the second magnet 17 in the expansion device 10. Specifically, with the above-described configuration, it is possible to detect whether the expansion device. 10 is attached to the predetermined position of the portable computer 1 in the correct posture or in the incorrect posture (e.g., upside-down posture). The control portion compares the magnetic field intensity detected by the magnetic-field-detecting element and a predetermined value. When the detected magnetic field intensity is larger than the predetermined value, the control portion judges that the "expansion device 10 is attached in the correct posture to the predetermined position of the portable computer 1" and then turns ON the switch. On the other hand, when the magnetic field intensity detected by the magnetic-field-detecting element is smaller than the predetermined value, the control portion judges that the "expansion device 10 is attached in the incorrect posture to the predetermined position of the portable computer 1" and then turns OFF the switch. Thus, only when the expansion device 10 is attached in the correct posture to the predetermined position of the portable computer 1, signals can be transmitted/received between the expansion device 10 and the portable computer 1, whereby improper electrical connections between the first terminal portion 5 and the second terminal portion 15 can be suppressed. Note here that the magnetic-field-detecting element may be provided in at least one of the first metallic portion 6 that is to be adsorbed magnetically by the first magnet 16 and the second metallic portion 7 that is to be adsorbed magnetically by the second magnet 17.

Figure 8:
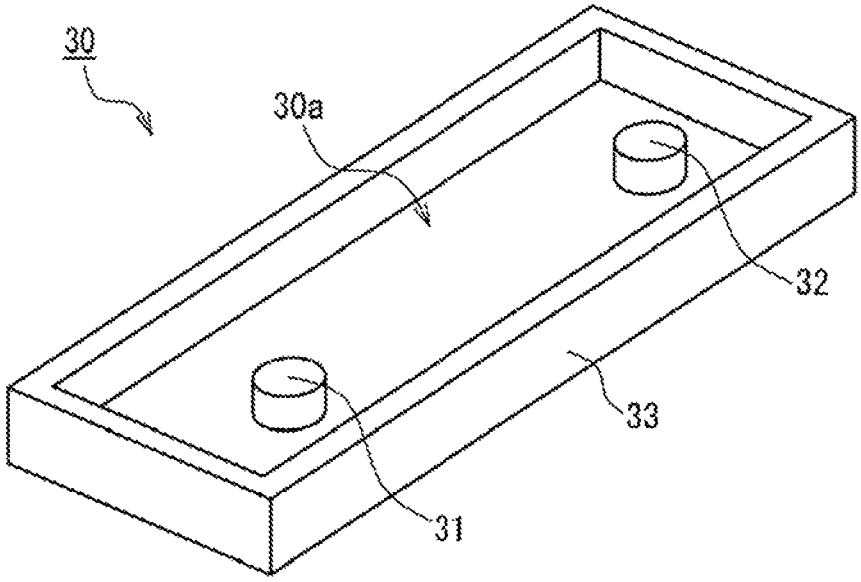
FIG. 8 is a perspective view of a cover member.
Figure 9:
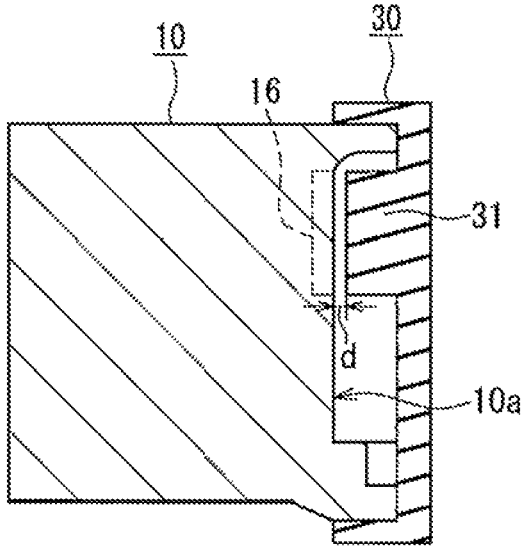
FIG. 9 is a cross-sectional view of the expansion device to which the cover member is attached.

FIG. 8 is a perspective view of a cover member 30. FIG. 9 is a cross-sectional view of the expansion device 10 to which the cover member 30 is attached. In the state where the expansion device 10 of the present embodiment is not attached to the. portable computer 1, the second terminal portion 15 is exposed. In this state, if moisture or a foreign substance such as dust is adhered to the second terminal portion 15, the second terminal portion 15 may be corroded and electrical signals may not be transmitted. Further, in the state where the expansion device 10 of the present embodiment is not attached to the portable computer 1, the second terminal portion 15, the first magnet 16 and the second magnet 17 are exposed.

In this state, if the first magnet 16 or second magnet 17 adsorbs a metallic clip or the like and the metallic clip contacts the second terminal portion 15, an electrical short circuit may occur between the electrical contacts, and the expansion device 10 may be damaged accordingly. Further, if an object that is susceptible to the magnetic field (e.g., a magnetic storage medium) is positioned close to the first magnet 16 or second magnet 17, information stored in the magnetic storage medium may be dissipated.

To cope with this, it is preferable that the side face 10*a* of the expansion device 10 is covered by the cover member 30 as shown in FIG. 8. Although in the present embodiment the entirety of the cover member 30 is formed of a metallic material that can be adsorbed by the magnet, the material of the cover member 30 is not limited hereto as long as at least a first protrusion 31 and a second protrusion 32 formed on a bottom portion 30*a* are formed of a metallic material that can be adsorbed by the magnet. A wall portion 33 is formed to surround the bottom portion 30*a*. The bottom portion 30*a* and the wall portion 33 have a dimension so that they can cover the side face 10*a*, the first support portion 18 and the second support portion 19 of the expansion device 10.

By bringing the first magnet 16 and the second magnet 17 to adsorb the first protrusion 31 and the second protrusion 32, the cover member 30 is attached to the expansion device 10 while covering the side face 10*a* of the expansion device 10. When the cover member 30 is attached to the side face 10*a* of the expansion device 10, there is a space between the bottom portion 30*a* and the second terminal portion 15. Thereby, when the entirety of the cover member 30 is formed of a metal, it is possible to suppress a magnetic leakage that is a leakage of the magnetic fields generated by the first magnet 16 and the second magnet 17 to the outside. Thus, with the bottom portion 30*a*, it is possible to avoid the electrical short circuit of the electrical contacts in the second terminal portion 15. Further, the object susceptible to the magnetic field (e.g., magnetic storage medium) can be positioned close to the first magnet 16 and second magnet 17.

In the present embodiment, as shown in FIG. 8, since the bottom portion 30*a* has a configuration capable of receiving the outer area of the second support portion 19 of the expansion device 10 including the second protrusion portion 19*b* and the third protrusion portion 19*c*, the adsorption direction of the expansion device 10 can be in both an upward and a downward directions with respect to the cover member 30. Further, in the present embodiment, since the cover member 30 is shaped by sheet-metal processing, it is possible to save time and manpower to form the shapes of the second protrusion portion 19*b* and the third protrusion portion 19*c* on the bottom portion 30*a*.

However, the cover member 30 also can be configured to have outer shapes of the second protrusion portion 19*b* and the third protrusion portion 19*c*. This configuration is preferable when, for example, a distance of the first support portion 18 and a distance of the second support portion 19 with respect to the first magnet 16 and the second magnet 17 in the expansion device 10 are largely different, since it is possible to determine uniquely the attachment direction of the expansion device 10 with respect to the cover member 30.

Further, in the present configuration, as shown in FIG. 9, the cover member 30 is adsorbed to the expansion device 10 via a space d between the first magnet 16 and the first protrusion 31 (the same can be said about a space between the second magnet 17 and the second protrusion 32). However, the space d is not limited hereto as long as it has a distance capable of shielding the magnetic field generated by the first magnet 16. The space d may be 0, that is, the first magnet 16 and the first protrusion 31 may be in intimate contact with each other. Note here that the attractive force generated between the first magnet 16 and the first protrusion 31 increases as the space d decreases, and the attractive force generated therebetween decreases as the space d increases. Therefore, by setting any space d, it is possible to obtain any attachment force of the cover member 30 with respect to the expansion device 10.

[4. Effect of Embodiment, Etc]

According to the present embodiment, by providing the first metallic portion 6 and the second metallic portion 7 in the portable computer 1 and providing the first magnet 16 and the second magnet 17 in the expansion device 10, it is possible to attach the expansion device 10 to the predetermined position of the portable computer 1 using the attractive forces generated by the first magnet 16 and the second magnet 17. Thus, the attachment/detachment of the expansion device 10 with respect to the portable computer 1 can be performed easily and speedily.

Further, according to the present embodiment, in the case where the portable computer 1 to which the expansion device 10 is attached is dropped mistakenly on the floor or the like, and the impact is applied on the expansion device 10, the expansion device 10 can be separated from the portable computer 1 easily. Thereby, the energy of the impact to be transmitted to the portable computer 1 can be reduced, and the damage to the portable computer 1 can be reduced accordingly. Therefore, it is more likely possible that only the expansion device 10 needs to be repaired, which results in a decrease in the repair cost.

Further, according to the present embodiment, by regulating the position of the expansion device 10 with respect to the portable computer 1 in the X-axis direction using the first support portion 18 and the first protrusion portion 19*a* as well as regulating the position thereof in the Y-axis direction by brining the second protrusion portion 19*b* and the third protrusion portion 19*c* to be engaged with the first concave portion 4*a* and the second concave portion 4*b*, respectively, it is possible to prevent the displacement due to a slight vibration, etc., of the expansion device 10 with respect to the portable computer 1. For example, by increasing the magnetic forces of the first magnet 16 and the second magnet 17, it is possible to suppress the displacement of the expansion device 10 to the portable computer 1. However, if the magnetic forces of the first magnet 16 and the second magnet 17 are increased excessively, the electric components in the portable computer 1 and the expansion device 10 may be adversely affected magnetically and a large pulling force is required at the time of intentionally separating the expansion device 10 from the portable computer 1. To cope with this, as in the present embodiment, by mechanically determining the position of the expansion device 10 with respect to the portable computer 1 using the first support portion 18 and the second support portion 19, it is unnecessary to increase the magnetic forces of the first magnet 16 and the second magnet 17 significantly. Thus, it is possible to suppress such magnetically adverse effects to the electric components in the portable computer 1 and the expansion device 10 and separate the expansion device 10 from the portable computer 1 easily.

Further, according to the present embodiment, since the expansion device 10 in the upside-down posture cannot be attached to the side face 1*b* of the portable computer 1, it is possible to prevent the first terminal portion 5 and the second terminal portion 15 to be connected electrically in the wrong combination. Therefore, malfunctions or breakdowns in the portable computer 1, the expansion device 10 and the peripheral devices connected to the expansion device 10 can be avoided.

Further, according to the present embodiment, the first metallic portion 6, the second metallic portion 7, the first magnet 16 and the second magnet 17 are ground potentials. In other words, magnetic adsorption means of the portable computer 1 and the expansion device 10 and means for electrically connecting the ground of the portable computer 1 and the ground of the expansion device 10 are shared. Therefore, it is unnecessary to additionally provide the portable computer 1 and the expansion device 10 with a terminal having a ground potential. Thus, the number of the terminals in the portable computer 1 and the expansion device 10 can be reduced, and the portable computer 1 and the expansion device 10 can be downsized accordingly.

Further, according to the present embodiment, by providing the first protrusion portion 19*a* in the expansion device 10, it is possible to raise the side face 10*a* of the expansion device 10 in the state where the expansion device 10 is attached to the portable computer 1 and placed on the desk, etc. Thus, the terminal provided in the side face 10*a* can be visually observed with ease, which enables a smooth connection of a cable to the terminal provided in the side face 10*a*.

Further, according to the present embodiment, by covering the side face 10*a* of the expansion device 10 with the cover member 30, it is possible to prevent the adherence of moisture or a foreign substance such as dust to the second terminal portion 15 in the state where the expansion device 10 is not attached to the portable computer 1.

Further, by covering the first magnet 16 and the second magnet 17 with the cover member 30, it is possible to reduce the possibility that the magnetic forces of the first magnet 16 and the second magnet 17 adversely affect products that are highly likely to dissipate data or to be damaged due to the magnetic field (a magnetic tape, an IC chip equipped card, etc.).

Although the expansion device 10 according to the present embodiment is configured to include the LAN port 11, etc., and be connectable with various cables, the configuration is not limited hereto. For example, the expansion device 10 may be a battery unit capable of feeding the portable computer 1, a communication unit containing antennas permitting wireless communication, a memory medium unit containing a hard disk or semiconductor memory, or a unit having slots to/from which various memory cards are attachable/detachable.

Further, in the present embodiment, although the portable computer 1 includes metallic portions and the expansion device 10 includes magnets, it is possible to have a configuration in which the portable computer 1 includes magnets and the expansion device 10 includes metallic portions. Note here that JP 07(1995)-295704 A discloses that "each section of the connector illustratively includes a permanent magnet (55, 65) to draw and hold the two sections in alignment, thereby providing a connector which is self-aligning". Further, the publication of JP 07-295704 A discloses that "each of the two mating sections (50, 60) of the connector includes a set of coupling plates (501, 502, 503, 601, 602, 603). When the two sections are brought into contact, the coupling plates form capacitors across which data signals can be passed. Circuitry (100, 200) driving each section of the data connector is such as to create a bidirectional signaling path, thereby providing a connection which is functionally equivalent to an ohmic connection". However, JP 07-295704 A does not disclose a configuration in which the connection between the two mating sections (50, 60) of the connector is prevented when it is attempted to connect one of the matching sections to the other in the upside-down posture. Further, although JP 07-295704 A discloses that data signals are passed across the capacitors formed by the coupling plates, it does not disclose a configuration in which terminals in respective connectors directly are connected electrically with each other. Further, JP 07-295704 A does not disclose the mechanical positioning between the connectors.

The first terminal portion 5 in the present embodiment is an example of the connection terminal. The portable computer 1 in the present embodiment is an example of the electronic device. The expansion device 10 in the present embodiment is an example of the expansion device. The second terminal portion 15 in the present embodiment is an example of the terminal. The first magnet 16 and the second magnet 17 in the present embodiment are examples of the magnets. The side face 1*b* of the portable computer 1 in the present embodiment is an example of the attachment face of the electronic device. The upper face 1*a* and the lower face 1*c* of the portable computer 1 in the present embodiment are examples of the side faces of the electronic device. The first support portion 18 and the second support portion 19 in the preset embodiment are examples of the support portions. The first support, portion 18 in the present embodiment is an example of the first support portion. The second support-portion 19 in the present embodiment is an example of the second support portion. The side face 10*a* of the expansion device 10 in the present embodiment is an example of the attachable face of the expansion device.

The present application is useful for an expansion device.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An expansion device adapted to be attached/detached to an attachment face of an electronic device where a connection terminal is present, the expansion device comprising:

an attachable face adapted to be opposed to the attachment face of the electronic device when the expansion device is attached to the electronic device;

a terminal on the attachment face, adapted to be connected electrically with the connection terminal;

a magnet adapted to exert an attraction force on a predetermined position in the attachment face of the electronic device; and a support portion adapted to support a face adjacent to the attachment face of the electronic device, wherein when the attachable face of the expansion device is opposed to the attachment face of the electronic device and the expansion device is brought into contact with the attachment face of the electronic device, the magnet is drawn to the electronic device to be at the predetermined position and the terminal and the connection terminal are connected electrically to each other, whereby the support portion supports the face adjacent to the attachment face of the electronic device.

2. The expansion device according to claim 1, wherein the support portion is composed of a first support portion and a second support portion respectively supporting a pair of opposed faces in the electronic device.

3. The expansion device according to claim 1, wherein the terminal is exposed on the attachable face of the expansion device, and the expansion device further comprises a removable cover member covering the terminal.

4. The expansion device according to claim 3, wherein at least a portion of the cover member is formed of a material attracted by the magnet.

5. The expansion device according to claim 2, wherein the second support portion has a first protrusion portion and a second protrusion portion that are arranged in a direction along the attachable face of the expansion device with a predetermined spacing therebetween, and when a thickness dimension of the attachment face of the electronic device is taken as H1, and a space dimension between the first support portion and the first and the second protrusion portions in the attachable face of the expansion device is taken as H12, a relationship of H12<H1 is satisfied.

* * * * *